US008683791B2

(12) United States Patent
Crane

(10) Patent No.: US 8,683,791 B2
(45) Date of Patent: Apr. 1, 2014

(54) METHOD AND SYSTEM FOR HOMOGENIZING EXHAUST FROM AN ENGINE

(75) Inventor: James M. Crane, Huron Township, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 296 days.

(21) Appl. No.: 12/860,026

(22) Filed: Aug. 20, 2010

(65) Prior Publication Data

US 2012/0042641 A1 Feb. 23, 2012

(51) Int. Cl.
*F01N 1/00* (2006.01)

(52) U.S. Cl.
USPC ..... 60/324; 60/274; 60/286; 60/288; 60/315; 60/317

(58) Field of Classification Search
USPC ..... 60/286, 288, 315, 317, 324, 274
See application file for complete search history.

(56) References Cited

U.S. PATENT DOCUMENTS

| | | | | | |
|---|---|---|---|---|---|
| 4,970,858 | A * | 11/1990 | Matsuoka | 60/274 |
| 5,050,376 | A * | 9/1991 | Stiglic et al. | 60/274 |
| 5,342,168 | A | 8/1994 | Weigel et al. | |
| 5,498,128 | A | 3/1996 | Baets et al. | |
| 5,542,249 | A | 8/1996 | Heath | |
| 5,676,522 | A | 10/1997 | Pommel et al. | |
| 5,730,580 | A | 3/1998 | Japikse | |
| 5,941,069 | A | 8/1999 | Heath | |
| 6,042,333 | A | 3/2000 | Day | |
| 6,546,728 | B2 | 4/2003 | Schmidt et al. | |
| 7,214,035 | B2 | 5/2007 | Bussieres et al. | |
| 7,464,691 | B2 * | 12/2008 | Conner | 123/306 |
| 7,490,467 | B2 | 2/2009 | Cummings | |
| 2003/0226539 | A1 * | 12/2003 | Kim | 123/306 |
| 2005/0217251 | A1 * | 10/2005 | Sato et al. | 60/295 |
| 2008/0022663 | A1 * | 1/2008 | Dodge et al. | 60/286 |
| 2008/0087013 | A1 * | 4/2008 | Crawley et al. | 60/320 |
| 2008/0098499 | A1 * | 4/2008 | Oxborrow | D23/314 |
| 2008/0273965 | A1 | 11/2008 | Rajamani et al. | |
| 2009/0151351 | A1 | 6/2009 | Zurawski et al. | |

* cited by examiner

*Primary Examiner* — Kenneth Bomberg
*Assistant Examiner* — Brandon Lee
(74) *Attorney, Agent, or Firm* — Snell & Wilmer LLP

(57) ABSTRACT

The present invention relates to a method and system for homogenizing exhaust from an engine. In one embodiment, the present invention includes an automobile. The automobile can include a fuel delivery unit, an engine, an exhaust system, and a control unit. The exhaust system can include a swirl inducement unit, multiple sensors, and multiple catalytic converters. The swirl inducement unit can homogenize an exhaust from the engine. The swirl inducement unit can include a plurality of vanes and/or a plurality of protrusions. The protrusions can be a plurality of bumps and/or a plurality of semi-circular rings. The plurality of vanes can be rotatable with the rotation of the vanes being controlled by the control unit. The rotation of the vanes can be based on an operating condition of the engine.

20 Claims, 6 Drawing Sheets

METHOD AND SYSTEM FOR HOMOGENIZING EXHAUST FROM AN ENGINE

BACKGROUND

1. Field

The present invention relates to a method and system for homogenizing exhaust from an engine.

2. Description of the Related Art

A conventional automobile includes an engine which generates an exhaust. The exhaust is sent to a catalytic converter where a catalytic process is performed on the exhaust and the result is outputted. However, the exhaust contains an air to fuel mixture ratio which may affect the implementation of the catalytic process. Thus, a sensor is included to detect the air-to-fuel ratio of the exhaust so that an amount of air and an amount of fuel used by the engine can be altered to change the air-to-fuel ratio in the exhaust.

However, the exhaust from the engine may not have a uniform distribution of air and fuel. This can affect the air-to-fuel ratio of the exhaust detected by the sensor depending on the location of the sensor. This can lead to an inaccurate detection of the air-to-fuel ratio by the sensor and subsequently affect the amount of air or the amount of fuel supplied to the engine. Since the catalytic process may be sensitive to the air-to-fuel ratio, any miscalculations in the input of the air or the fuel to the engine can lead to the exhaust having a higher or lower air-to-fuel ratio than desired for the catalytic process. This can result in an undesirable output by the catalytic converter, the exhaust system, and/or the automobile.

Thus, there is a need for a method and system for homogenizing exhaust from an engine.

SUMMARY

The present invention relates to a method and system for homogenizing exhaust from an engine. In one embodiment, the present invention includes, for example, an automobile. The automobile can include, for example, a fuel delivery unit, an engine, an exhaust system, and a control unit.

The exhaust system can include, for example, a swirl inducement unit, multiple sensors, and multiple catalytic converters. The swirl inducement unit can, for example, homogenize an exhaust from the engine. The swirl inducement unit can include, for example, a plurality of vanes and/or a plurality of protrusions. The protrusions can be, for example, a plurality of bumps and/or a plurality of semi-circular rings. The plurality of vanes can, for example, be rotatable with the rotation of the vanes being controlled by the control unit. The rotation of the vanes can be based on, for example, an operating condition of the engine.

In operation, the fuel delivery unit can deliver fuel to the engine. The engine can consume the fuel and generate exhaust. The swirl inducement unit homogenizes the exhaust and the plurality of sensors detect exhaust data from the homogenized exhaust. Catalytic processes are performed on the homogenized exhaust in the plurality of catalytic converters and the result is outputted from the exhaust system and/or the automobile.

In one embodiment, the present invention is an exhaust system including a swirl inducement unit configured to substantially homogenize an exhaust from an engine.

In another embodiment, the present invention is an automobile including an engine generating an exhaust, and an exhaust system receiving the exhaust, the exhaust system including a pipe connected to the engine, wherein the exhaust travels through the pipe, a swirl inducement unit connected to the pipe and configured to substantially homogenize the exhaust, and a sensor configured to detect exhaust data of the exhaust.

In yet another embodiment, the present invention is a method for homogenizing exhaust from an engine including using a swirl inducement unit to substantially homogenize the exhaust, and detecting exhaust data of the substantially homogenized exhaust.

BRIEF DESCRIPTION OF THE DRAWINGS

The features, obstacles, and advantages of the present invention will become more apparent from the detailed description set forth below when taken in conjunction with the drawings, wherein.

DETAILED DESCRIPTION

Figure 1:
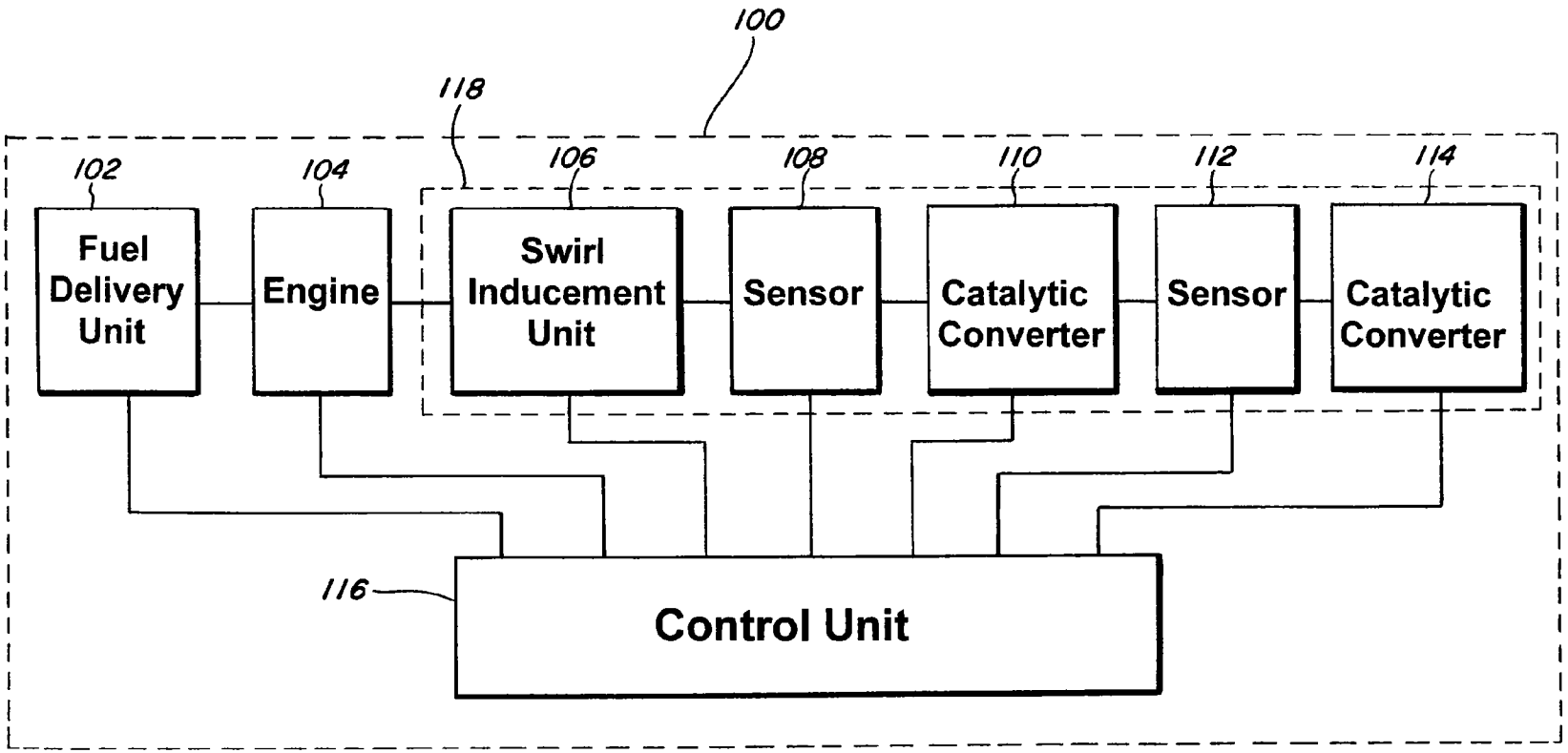
FIG. 1 depicts a box diagram of an automobile including an exhaust system with a swirl inducement unit according to an embodiment of the present invention.

Apparatus, systems and methods that implement the embodiments of the various features of the present invention will now be described with reference to the drawings. The drawings and the associated descriptions are provided to illustrate some embodiments of the present invention and not to limit the scope of the present invention. Throughout the drawings, reference numbers are re-used to indicate correspondence between referenced elements.

In one embodiment, the present invention includes an automobile 100. The automobile 100 can include, for example, a fuel delivery unit 102, an engine 104, a control unit 116, and/or an exhaust system 118. The automobile 100 can be, for example, a car with an internal combustion engine, a hybrid engine, a hydrogen engine, or any other type of engine which produces an exhaust.

The fuel delivery unit 102 is connected, for example, to the engine 104 and/or the control unit 116. The fuel delivery unit 102 delivers fuel to the engine 104. The fuel can be, for example, any type of combustible fuel such as gasoline, ethanol, or hydrogen. The engine 104 is connected, for example, to the fuel delivery unit 102, the exhaust system 118, and/or the control unit 116. The engine 104 receives the fuel from the fuel delivery unit 102, combusts the fuel, and generates exhaust which is fed to the exhaust system 118.

The exhaust system 118 is connected, for example, to the engine 104 and/or the control unit 116. The exhaust system 118 receives the exhaust from the engine 104, allows the exhaust to undergo a catalytic process and outputs the result. The exhaust system 118 can include, for example, a swirl inducement unit 106, a sensor 108, a catalytic converter 110, a sensor 112, and/or a catalytic converter 114. Although multiple sensors and catalytic converters are shown in FIG. 1, only a single sensor, or a single catalytic converter may also be used, as well as any number of sensors or catalytic converters. The swirl inducement unit 106 receives and homogenizes the exhaust from the engine 104.

The homogenized exhaust is sent to the sensor 108 where exhaust data, such as the air-to-fuel mixture ratio, is detected before the homogenized exhaust is passed to the catalytic converter 110. The catalytic converter 110 subjects the homogenized gas to a catalytic process and outputs the result to the sensor 112 where the exhaust data, such as the air-to-fuel mixture ratio, is detected. The homogenized gas is sent to the catalytic converter 114 for another round of catalytic processing and the result is outputted from the exhaust system 118 and/or the automobile 100.

The control unit 116 is connected, for example, to the fuel delivery unit 102, the engine 104, the swirl inducement unit 106, the sensor 108, the catalytic converter 110, the sensor 112, and/or the catalytic converter 114. The control unit 116 can be, for example, a processor and/or a memory. In one embodiment, the control unit 106 can control, for example, the operations of the swirl inducement unit 106 based on the data detected by the sensor 108 and/or the sensor 112.

Figure 2:
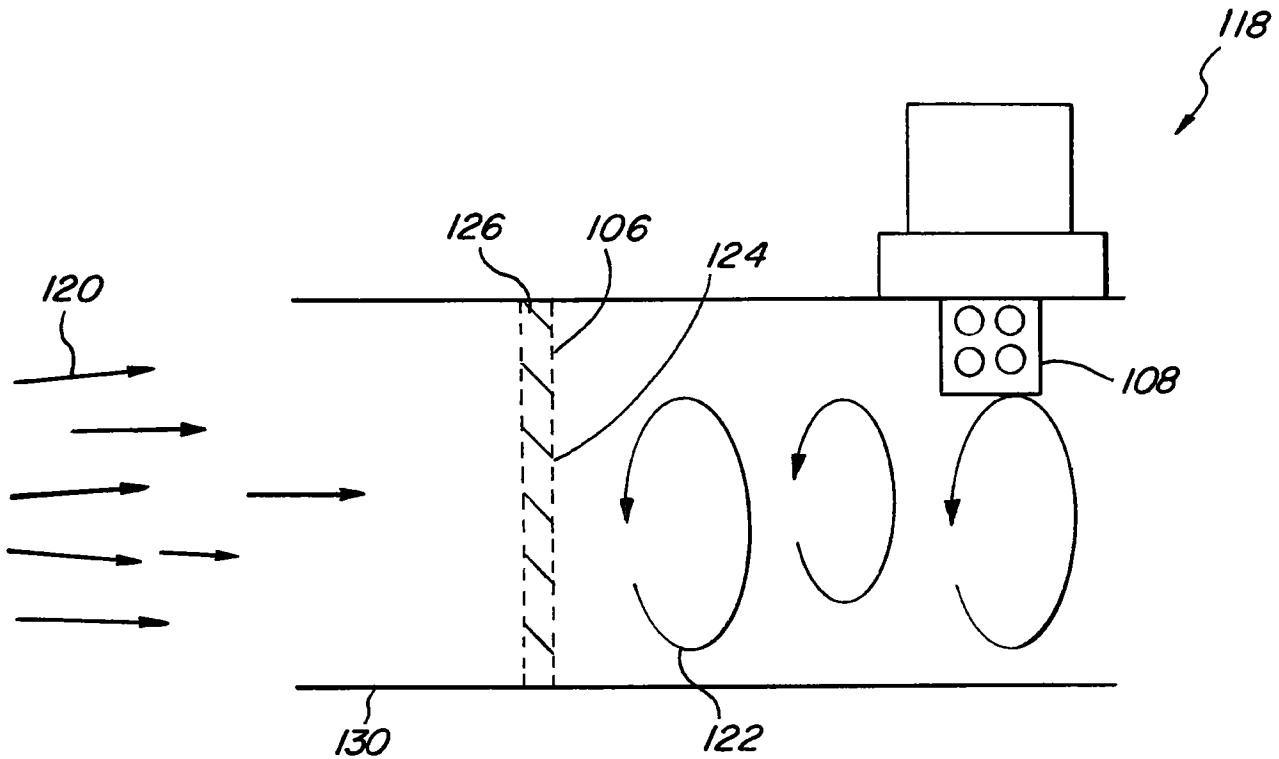
FIG. 2 depicts an exhaust system including a swirl inducement unit according to an embodiment of the present invention.

The exhaust system 118 can be seen in more detail in FIG. 2. In one embodiment, the exhaust system 118 includes a pipe 130, the swirl inducement unit 106 and/or the sensor 108. The swirl inducement unit 106 can include, for example, a pipe section 124 and a plurality of vanes 126. The pipe section 124 can be part of the pipe 130. The vanes 126 can be attached to the pipe section 124 and can be stationary or rotatable. If the vanes 126 are rotatable, the rotation of the vanes 126 can be controlled, for example, by the control unit 106.

Figure 4:
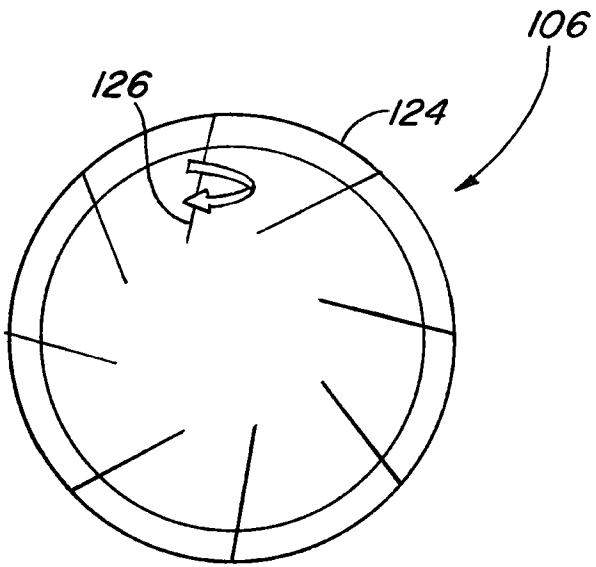
FIG. 4 depicts a swirl inducement unit including a plurality of vanes which are rotated according to an embodiment of the present invention.
Figure 3:
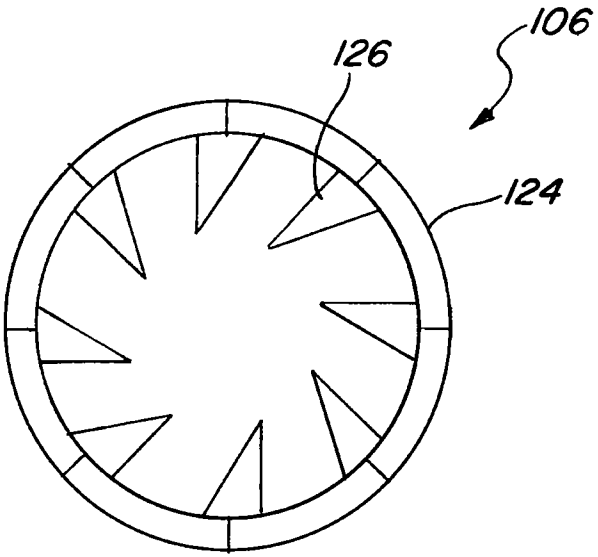
FIG. 3 depicts a swirl inducement unit including a plurality of vanes according to an embodiment of the present invention.

In FIG. 2, the exhaust system 118 receives the exhaust 120 from the engine 104. As the exhaust passes by the swirl inducement unit 106, the vanes 126 aids in homogenizing the exhaust 120 to produce a substantially homogenized exhaust 122. The vanes 126 can be rotated to increase or decrease the amount of homogenization and/or the swirl patterns induced in the exhaust 120 to form the substantially homogenized exhaust 122. For example, as seen in FIG. 3, the vanes 126 can have a maximum amount of surface area relative to the directional flow of the exhaust 120. Thus, the vanes 126 can induce a large amount of swirls in the exhaust 120. However, as seen in FIG. 4, the vanes 126 can also be rotated to decrease or minimize the amount of surface area relative to the directional flow of the exhaust 120. The vanes 126 can also be rotated back from FIG. 4 to FIG. 3 or any portion thereof.

Figure 6:
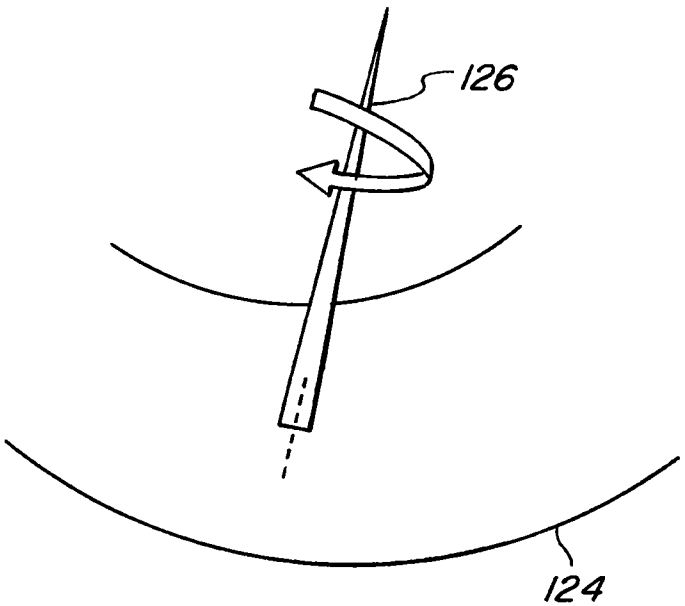
FIG. 6 depicts a vane rotated about an axis according to an embodiment of the present invention.
Figure 5:
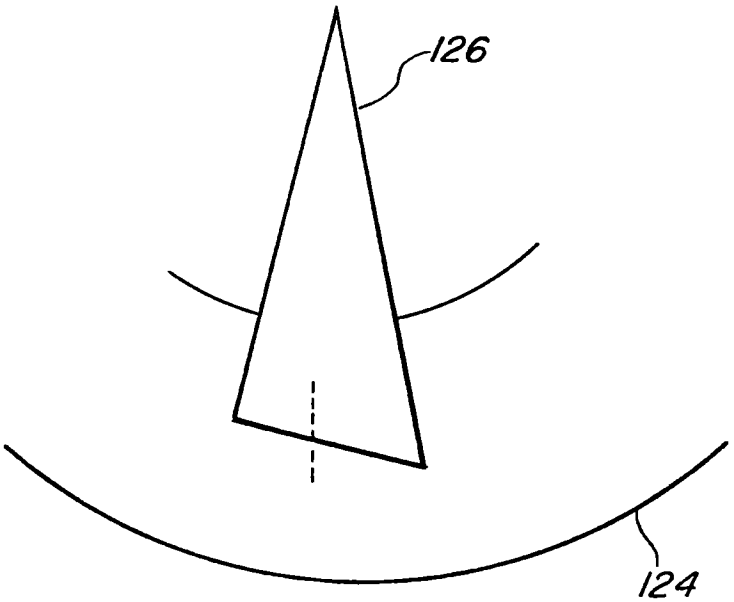
FIG. 5 depicts a vane according to an embodiment of the present invention.

The rotation of the vanes 126 can also be seen in FIG. 5 and FIG. 6. In FIG. 5, the vanes 126 are not rotated, while in FIG. 6, the vanes 126 are rotated about an axis. Although the vanes 126 are shown to be triangular shaped, they can be of any shape, such as square, circular, semi-circular, and/or oval, which can aid in homogenizing the exhaust 120.

In one embodiment, the vanes 126 can be rotated depending on the homogenization requirements of the exhaust 122. In another embodiment, the vanes 126 can be rotated based on the operating conditions of the engine 104. For example, when the engine is operating at a low condition, such as when the automobile 100 is not going very fast or there is a reduced load on the engine 104, the vanes 126 can be rotated to increase the surface area of the vanes 126 relative to the directional flow of the exhaust 120. This can also be seen, for example, in FIG. 5. This can increase, for example, the homogenization of the exhaust 120. When the engine is operating at the low condition, the exhaust 120 may tend to be non-homogenized.

However, when the engine is operating at a high condition, such as when the automobile 100 is going very fast or there is an increased load on the engine 104, the vanes 126 can be rotated to decrease the surface area of the vanes 126 relative to the directional flow of the exhaust 120. This can be seen, for example, in FIG. 6. This can increase, for example, the flow of the exhaust 120 and may improve the efficiency of the automobile 120. The surface area of the vanes 126 relative to the directional flow of the exhaust 120 can be decreased because when the engine 104 is operating under high conditions, the exhaust 120 may have substantial swirling already and thus may be already substantially homogenized, reducing a necessity for homogenization of the exhaust 120. As previously noted, the rotation of the vanes 126 can be controlled by the control unit 116.

Referring back to FIG. 2, the substantially homogenized exhaust is analyzed by the sensor 108. By homogenizing the exhaust 120, the sensor 108 is able to obtain a more accurate reading of the exhaust data of the substantially homogenized exhaust 122. The substantially homogenized exhaust 122 allows for more accurate exhaust data to be collected since non-homogenized exhaust, such as the exhaust 120 may have higher concentrations of air or fuel in certain portions. The rotation of the vanes 126 can also be in direct response to the exhaust data detected by the sensor 108 and/or the sensor 112.

In conventional systems, the exhaust data for an exhaust detected by a sensor may vary depending on the location of the sensor. Therefore, the sensor may not receive accurate exhaust data because the exhaust data will vary depending on the location of the sensor.

However, the swirl inducement unit 106 of the present invention homogenizes the exhaust 120 of the engine 104. The substantially homogenized exhaust 122 allows for a more accurate reading of the exhaust data since the air and fuel mixture is more consistent throughout the substantially homogenized exhaust 122. This allows for a more consistent reading of the exhaust data regardless of the position of the sensor 108. Thus, for example, a more accurate air-to-fuel ratio of the exhaust of the engine can be obtained. This can lead to reduced emissions from the exhaust system 118 and/or the automobile 100.

Figure 8:
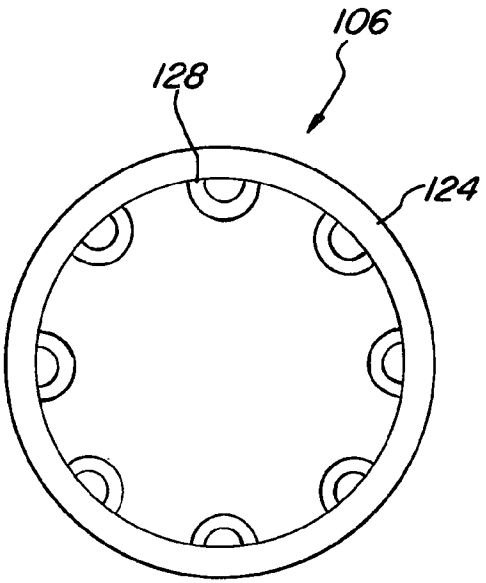
FIG. 8 depicts a swirl inducement unit including a plurality of protrusions according to an embodiment of the present invention.
Figure 7:
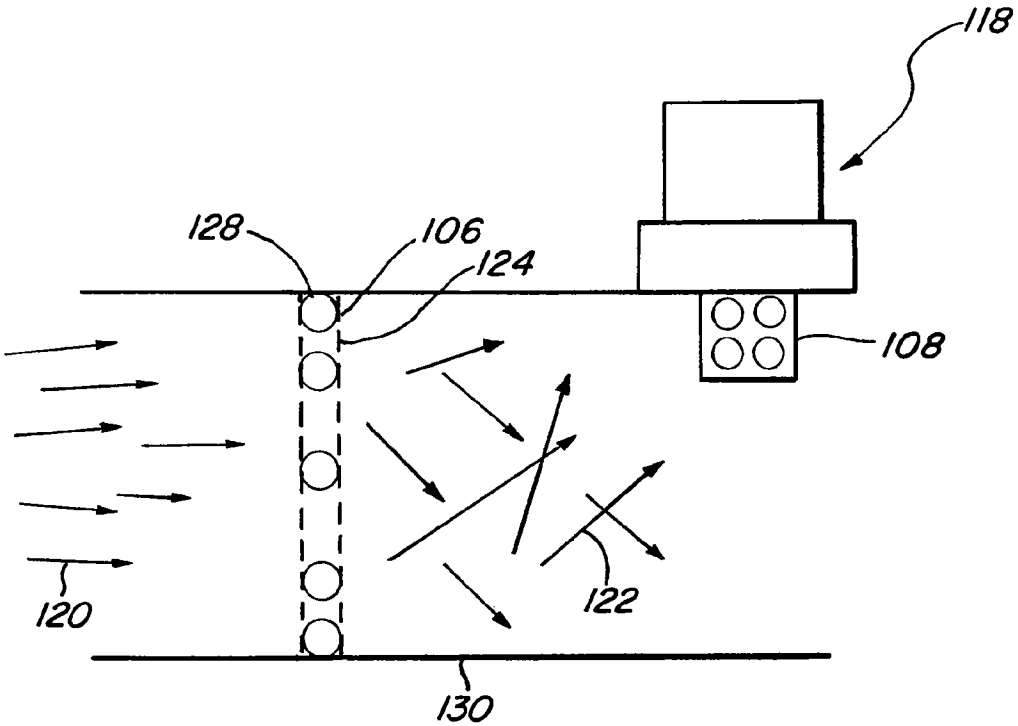
FIG. 7 depicts an exhaust system including a swirl inducement unit according to an embodiment of the present invention.

In another embodiment, the swirl inducement unit 106 includes a plurality of protrusions 128 located on the pipe section 124 as seen in FIG. 7 and FIG. 8. The protrusions 128 can be, for example, bumps and/or semi-circular rings. In FIG. 7 and FIG. 8, the protrusions 128 can homogenize the exhaust 120 of the engine 104. However, the substantially homogenized gas 122 need not be swirled, but instead, can be scattered. In such a situation, the substantially homogenized gas 122 is still sufficiently homogenized such that the accuracy of the exhaust data detected by the sensor 108 is improved.

In one embodiment, the swirl inducement unit 106 can use both the vanes 126 and/or the protrusions 128. In addition, the swirl inducement unit 106 can use other devices aside from the vanes 126 and/or the protrusions 128 which substantially homogenize the exhaust 120.

Figure 9:
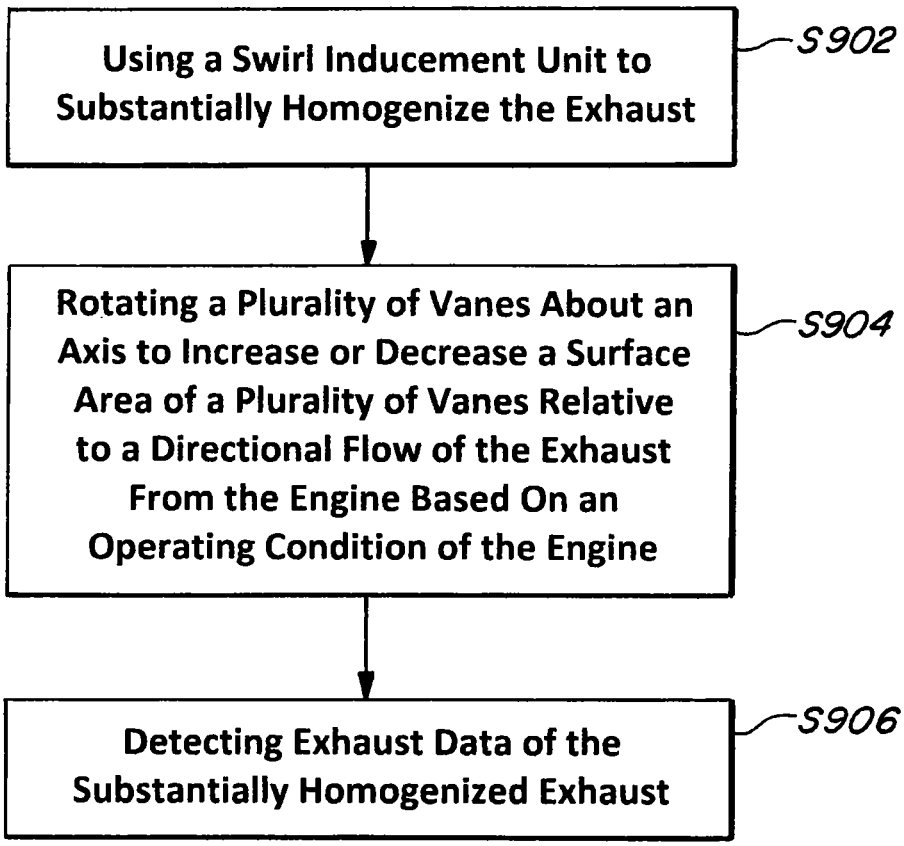
FIG. 9 depicts a process according to an embodiment of the present invention.

In yet another embodiment, the present invention is a process as shown in FIG. 9. In Step S902, a swirl inducement unit 106 is used to substantially homogenize the exhaust. For example, the swirl inducement unit 106 in the exhaust system 118 can be used to substantially homogenize the exhaust from the engine 104.

In Step S904, a plurality of vanes can be rotated about an axis to increase or decrease a surface area of the plurality of vanes relative to a directional flow of the exhaust from the engine based on an operating condition of the engine. For example, if the swirl inducement unit 106 includes the vanes 126, the vanes 126 can be rotated about an axis to increase or decrease a surface area of the vanes 126 relative to a directional flow of the exhaust from the engine 104 based on the operating condition of the engine.

When the engine is operating at a low condition, the vanes 126 can be rotated to increase a surface area of the vanes 126 relative to a directional flow of the exhaust. However, when the engine is operating at a high condition, the vanes 126 can be rotated to decrease a surface area of the vanes 126 relative to a directional flow of the exhaust. Step S904 is optional, such as when the vanes 126 are not rotatable and/or the protrusions 128 are used instead of the vanes 126.

In Step S906, exhaust data of the substantially homogenized exhaust is detected. For example, the sensor 108 and/or the sensor 112 can detect the exhaust data of the substantially homogenized exhaust. The exhaust data can be, for example, an air-to-fuel ratio of the substantially homogenized exhaust.

Those of ordinary skill would appreciate that the various illustrative logical blocks, modules, and algorithm steps described in connection with the examples disclosed herein may be implemented as electronic hardware, computer software, or combinations of both. Furthermore, the present invention can also be embodied on a machine readable medium causing a processor or computer to perform or execute certain functions.

To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosed apparatus and methods.

The various illustrative logical blocks, units, modules, and circuits described in connection with the examples disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the examples disclosed herein may be embodied directly in hardware, in a software module executed by a processor, or in a combination of the two. The steps of the method or algorithm may also be performed in an alternate order from those provided in the examples. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an Application Specific Integrated Circuit (ASIC). The ASIC may reside in a wireless modem. In the alternative, the processor and the storage medium may reside as discrete components in the wireless modem.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. An exhaust system comprising:

a swirl inducement unit including a plurality of vanes and a pipe section, with the pipe section configured for an exhaust from an engine to pass therethrough and having a completely open central portion, each of the plurality of vanes having a first end connected to the pipe section and a second end extending away from the first end in a direction towards the completely open central portion, each of the plurality of vanes being rotatable about a corresponding axis to increase or decrease a surface area of the plurality of vanes relative to a directional flow of the exhaust through the pipe section, the plurality of vanes being configured to substantially homogenize the exhaust when the exhaust passes through the pipe section to thereby produce a substantially homogenized exhaust;

an air-to-fuel ratio sensor configured to detect an air-to-fuel ratio of the substantially homogenized exhaust produced by the swirl inducement unit; and an electronic control unit configured to:

rotate each of the plurality of vanes about the corresponding axis of the vane to thereby decrease the surface area of the plurality of vanes relative to the directional flow of the exhaust through the pipe section when there is a relative increase in the directional flow of the exhaust, and rotate each of the plurality of vanes about the corresponding axis of the vane to thereby increase the surface area of the plurality of vanes relative to the directional flow of the exhaust through the pipe section when there is a relative decrease in the directional flow of the exhaust.

2. The system of claim 1 wherein the pipe section is a section of a pipe, the pipe configured such that the exhaust from the engine travels through the pipe to reach the swirl inducement unit.

3. The system of claim 1 wherein the swirl inducement unit includes a plurality of bumps extending from the pipe section in a direction towards the completely open central portion, or includes a plurality of semi-circular rings extending from the pipe section in a direction towards the completely open central portion.

4. An automobile comprising:

an engine for generating an exhaust; and an exhaust system for receiving the exhaust, the exhaust system including a pipe connected to the engine, wherein the exhaust travels through the pipe, a swirl inducement unit connected to the pipe and having an unobstructed central portion and including a plurality of vanes, each of the plurality of vanes having a first end connected to the pipe and a second end extending from the first end in a direction towards the unobstructed central portion, each of the plurality of vanes being rotatable about a corresponding axis to increase or decrease a surface area of the plurality of vanes relative to a directional flow of the exhaust through the pipe, the plurality of vanes being configured to substantially homogenize the exhaust when the exhaust passes through the pipe to thereby produce a substantially homogenized exhaust, a sensor configured to detect an air-to-fuel ratio of the substantially homogenized exhaust produced by the swirl inducement unit, and an electronic control unit configured to:

rotate each of the plurality of vanes about the corresponding axis of the vane to thereby decrease the surface area of the plurality of vanes relative to the directional flow of the exhaust through the pipe section when there is a relative increase in the directional flow of the exhaust, and rotate each of the plurality of vanes about the corresponding axis of the vane to thereby increase the surface area of the plurality of vanes relative to the directional flow of the exhaust through the pipe when there is a relative decrease in the directional flow of the exhaust.

5. The automobile of claim 4 wherein each of the plurality of vanes have a semi-circular shape, a triangular shape, a square shape, a circular shape, or an oval shape.

6. The automobile of claim 4 wherein the swirl inducement unit includes a plurality of bumps extending from the pipe in a direction towards the unobstructed central portion.

7. The automobile of claim 4 wherein the swirl inducement unit includes a plurality of semi-circular rings extending from the pipe in a direction towards the unobstructed central portion.

8. A method for homogenizing exhaust from an engine comprising:

substantially homogenizing the exhaust by passing the exhaust through a pipe section of a swirl inducement unit having a plurality of vanes, with the pipe section having a completely open central portion, and each of the plurality of vanes having a first end connected to the pipe section and a second end extending away from the first end in a direction towards the completely open central portion, each of the plurality of vanes being rotatable about a corresponding axis to increase or decrease a surface area of the plurality of vanes relative to a directional flow of the exhaust through the pipe section;

detecting, with a sensor, an air-to-fuel ratio of the substantially homogenized exhaust;

rotating, using an electronic control unit, each of the plurality of vanes about the corresponding axis of the vane to thereby decrease the surface area of the plurality of vanes relative to the directional flow of the exhaust through the pipe section when there is a relative increase in the directional flow of the exhaust; and rotating, using the electronic control unit, each of the plurality of vanes about the corresponding axis of the vane to thereby increase the surface area of the plurality of vanes relative to the directional flow of the exhaust through the pipe section when there is a relative decrease in the directional flow of the exhaust.

9. The method of claim 8 wherein the swirl inducement unit includes a plurality of bumps extending from the pipe section in a direction towards the completely open central portion, or includes a plurality of semi-circular rings extending from the pipe section in a direction towards the completely open central portion.

10. The system of claim 1 wherein each of the plurality of vanes have a semi-circular shape, a triangular shape, a square shape, a circular shape, or an oval shape.

11. The system of claim 2 wherein the air-to-fuel ratio sensor is connected to the pipe, with the pipe configured such that the substantially homogenized exhaust from the swirl inducement unit travels through the pipe to reach the air-to-fuel ratio sensor.

12. The system of claim 11 further comprising a catalytic converter positioned such that the substantially homogenized exhaust from the swirl inducement unit passes the air-to-fuel ratio sensor before reaching the catalytic converter.

13. The system of claim 12 wherein the catalytic converter is a first catalytic converter and the air-to-fuel ratio sensor is a first air-to-fuel ratio sensor, and the system further comprises a second catalytic converter and a second air-to-fuel ratio sensor being positioned such that the substantially homogenized exhaust from the first catalytic converter passes the second air-to-fuel ratio sensor before reaching the second catalytic converter, the second air-to-fuel ratio sensor being configured to detect an air-to-fuel ratio of the substantially homogenized exhaust passing from the first catalytic converter to the second catalytic converter.

14. The system of claim 13 wherein the electronic control unit is connected to the first air-to-fuel ratio sensor, to the second air-to-fuel ratio sensor, and to the swirl inducement unit.

15. The system of claim 14 wherein the electronic control unit is configured to rotate each of the plurality of vanes about the corresponding axis of the vane in response to the air-to-fuel ratio detected by the first air-to-fuel ratio sensor and the air-to-fuel ratio detected by the second air-to-fuel ratio sensor.

16. The automobile of claim 4 wherein the pipe is configured such that the substantially homogenized exhaust from the swirl inducement unit travels through the pipe to reach the sensor.

17. The automobile of claim 4 further comprising a catalytic converter positioned such that the substantially homogenized exhaust from the swirl inducement unit passes the sensor before reaching the catalytic converter.

18. The automobile of claim 4 wherein the electronic control unit is connected to the sensor and to the swirl inducement unit.

19. The method of claim 8 further comprising passing the substantially homogenized exhaust from the swirl inducement unit to a catalytic converter.

20. The method of claim 19 wherein the sensor is positioned such that the substantially homogenized exhaust passes the sensor to reach the catalytic converter.

* * * * *